US009280083B2

(12) United States Patent
Lamers

(10) Patent No.: US 9,280,083 B2
(45) Date of Patent: Mar. 8, 2016

(54) IMAGE FORMING DEVICE COMPRISING A DIRECT IMAGE FORMING ELEMENT

(71) Applicant: OCE-TECHNOLOGIES B.V., Venlo (NL)

(72) Inventor: Norbert H. W. Lamers, Reuver (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/472,630

(22) Filed: Aug. 29, 2014

(65) Prior Publication Data

US 2014/0368597 A1 Dec. 18, 2014

Related U.S. Application Data

(63) Continuation of application No. PCT/EP2013/057069, filed on Apr. 4, 2013.

(30) Foreign Application Priority Data

Apr. 19, 2012 (EP) ..... 12164792

(51) Int. Cl.
*G03G 15/34* (2006.01)
*G03G 15/08* (2006.01)
*G03G 17/00* (2006.01)

(52) U.S. Cl.
CPC ..... *G03G 15/0822* (2013.01); *G03G 15/34* (2013.01); *G03G 17/00* (2013.01); *G03G 2215/0651* (2013.01)

(58) Field of Classification Search
CPC . G03G 15/75; G03G 15/751; G03G 5/14704; G03G 15/754; G03G 15/80
See application file for complete search history.

(56) References Cited

U.S. PATENT DOCUMENTS 3,909,258 A 9/1975 Kotz
4,120,720 A * 10/1978 Gross ..... 430/62

(Continued)

FOREIGN PATENT DOCUMENTS

EP 0 191 521 A1 8/1986
EP 0 295 532 A2 12/1988

(Continued)

*Primary Examiner* — Clayton E Laballe
*Assistant Examiner* — Ruifeng Pu
(74) *Attorney, Agent, or Firm* — Birch, Stewart, Kolasch & Birch, LLP

(57) ABSTRACT

An image forming device includes at least one image forming element moving past an image forming station in which toner is deposited on a surface of the image forming element, which surface is facing the image forming station, said image forming element including a core layer forming a core of the image forming element and including a plurality of tracks comprising electrodes individually connected to corresponding drivers, and a semi-conducting top layer forming the surface of the image forming element, wherein the image forming element further includes an isolating layer in-between the core layer and the semi-conducting top layer, which isolating layer includes a plurality of pads each of which extends over at least one track in a non-overlapping manner, extends towards one underlying track as to form an interconnection with the one underlying track, and is filled with a conducting material in order to let each pad individually be activated by means of the driver of the underlying track in order to adhere toner on a location of the surface of the image forming element, which location corresponds to the underlying activated pad.

8 Claims, 3 Drawing Sheets

(56) References Cited

U.S. PATENT DOCUMENTS

| | | | | |
|---|---|---|---|---|
| 6,285,382 | B1 * | 9/2001 | Wakahara et al. | 347/112 |
| 2003/0022477 | A1 * | 1/2003 | Hsieh | H01L 21/4853 438/612 |
| 2005/0259140 | A1 * | 11/2005 | Kim et al. | 347/140 |
| 2006/0290765 | A1 * | 12/2006 | Acquoij et al. | 347/111 |
| 2007/0144009 | A1 * | 6/2007 | Lee et al. | 29/895.2 |
| 2008/0131175 | A1 | 6/2008 | Shin et al. | |
| 2009/0092927 | A1 * | 4/2009 | Choi et al. | 430/314 |
| 2009/0119917 | A1 * | 5/2009 | Yoon et al. | 29/887 |
| 2010/0020153 | A1 * | 1/2010 | Yoon et al. | 347/111 |
| 2011/0039196 | A1 * | 2/2011 | Kanungo et al. | 430/58.05 |
| 2012/0037026 | A1 * | 2/2012 | Law et al. | 101/492 |
| 2012/0218364 | A1 * | 8/2012 | Cardoso et al. | 347/127 |

FOREIGN PATENT DOCUMENTS

| | | | |
|---|---|---|---|
| EP | 0 304 983 | A1 | 3/1989 |
| EP | 0 803 782 | A1 | 10/1997 |
| EP | 1 253 481 | A2 | 10/2002 |

* cited by examiner

IMAGE FORMING DEVICE COMPRISING A DIRECT IMAGE FORMING ELEMENT

CROSS REFERENCE TO RELATED APPLICATIONS

This application is a Continuation of PCT International Application No. PCT/EP2013/057069, filed on Apr. 4, 2013, which claims priority under 35 U.S.C. 119(a) to patent application Ser. No. 12/164,792.9, filed in Europe on Apr. 19, 2012, all of which are hereby expressly incorporated by reference into the present application.

The invention relates to an image forming device comprising at least one image forming element moving past an image forming station in which toner is deposited on a surface of the image forming element, which surface is facing the image forming station, the image forming element comprising a core layer forming a core of the image forming element and comprising a plurality of tracks comprising electrodes individually connected to corresponding drivers, and a semi-conducting top layer forming the surface of the image forming element.

Such image forming devices are used in image reproduction systems, e.g. copiers or printers, in which a toner image is formed on a surface of an image forming element.

Especially the invention relates to a so-called direct imaging process in which toner particles from a supply of toner in an image forming zone, are directly deposited on a semiconducting surface as a result of electrical energisation of a printing electrode. Such direct imaging process are well known and are described e.g. in U.S. Pat. No. 3,909,258, EP 191521, EP 295532, EP 304983 and EP 1253481.

The image forming element is typically formed by a cylindrical drum or an endless belt which moves past an image forming station where toner substance is applied to the semi-conducting surface of the drum or belt under the control of electronic drivers and in accordance with the image information to be printed. The drivers control electrodes which generate an electric field for attracting the toner particles to the surface of the image forming element. A detailed description of the mechanism of toner deposition in a direct imaging process is provided in the above mentioned EP 191521.

The toner image that has been formed on the surface of the moving image forming element is then carried on to a transfer station where the toner image is transferred onto an intermediate image carrier or directly onto a recording sheet.

The surface area on which the amount of toner is deposited will be defined by the configuration of the electrode and may incorporate the entire surface of the image forming element or only e.g. a small portion thereof.

The image forming device has a disadvantage that the print quality, especially the graininess, is influenced by the starting and stopping of the toner position on a front edge and a back edge of an activated or deactivated image forming element which tangentially extends around the drum surface. A starting or stopping of a toner position on a front edge or a back edge of an activated or deactivated electrode can not exactly and steady executed. On the other hand, a complete digitally drivable drum per single area at which toner is deposited is however very complicated to realise.

It is an object of the invention to provide an image forming device which mitigates the disadvantages of a drum with elongated electrodes as described here-above.

According to the invention, this object is achieved by an image forming device according to the preamble, wherein the image forming element further comprises an isolating layer in-between the core layer and the semi-conducting top layer, which isolating layer comprises a plurality of pads each of which extends over at least one track in a non-overlapping manner, extends towards one underlying track as to form an interconnection with the one underlying track, and is filled with a conducting material in order to let each pad individually be activated by means of the driver of the underlying track in order to adhere toner on a location of the surface of the image forming element, which location corresponds to the underlying activated pad.

The invention is based on the effect that a pad comprises at least one conducting material. The pads are shaped in such a way that the pad can address an area of toner substance to be deposited on the image forming station. A voltage can be set on the track. At the location of the pad corresponding to the track the circumference of the pad—at least in the first direction of the image forming element and in the second direction of the image forming element—determines a rigorous and strict separation of an area in which the toner is developed and an area in which the toner is not developed on the image forming station. This results in an accurate placement of toner at an image to be formed and decreases the graininess. The emerging of image edges is less dependent on the varying position of a toner amount at a surface area between the image forming element and the image forming station, because an area determined by the pad is to be activated and deactivated at predetermined times.

By defining a development area more accurately by means of a pad an improved edge sharpness and graininess is obtained, but there are also advantages with respect to a direct imaging knife and toner properties. Mechanical and physical properties of the direct imaging knife may have larger tolerances. Toner properties with respect to a particle size distribution may also have larger tolerances regarding their specifications.

The number of electrodes which is coupled to a same number of pads determines a resolution of the image forming device in the second direction. If the image forming device has a maximal predetermined resolution in the second direction, clustering of a number of electrodes per pad reduces the resolution in the second direction accordingly.

The resolution in the first direction is determined by the pitch of the pads in first direction and is determined during production of the image forming element. The desired pitch may be determined by a length of a toner amount at a surface area between the image forming device and the image forming station, sharpness of the magnetic knife, the resolution of the image forming element in the second direction and the particle size distribution of the toner substance.

Preferred embodiments of the invention will now be described in conjunction with the drawings, in which.

Figure 1:
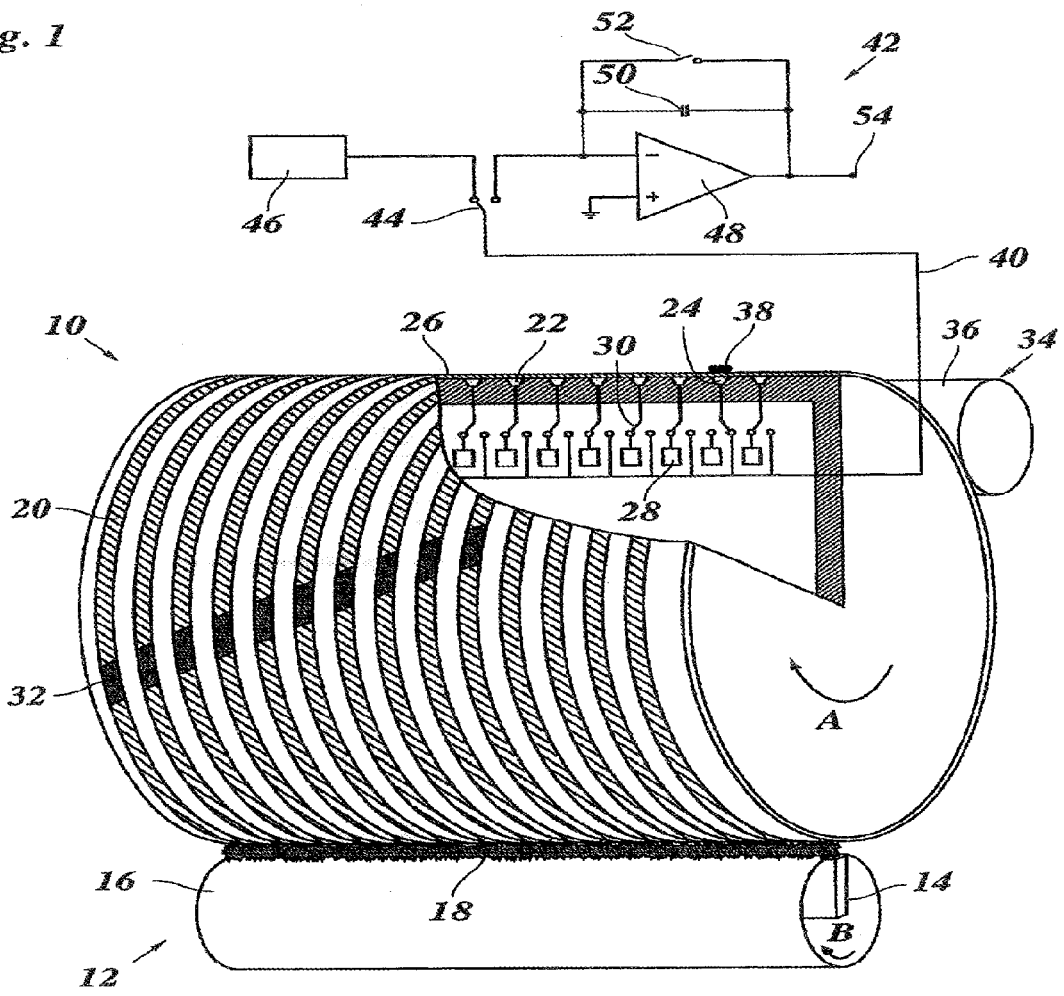
FIG. 1 is a schematic diagram of an image forming device according to the invention.
Figure 4:
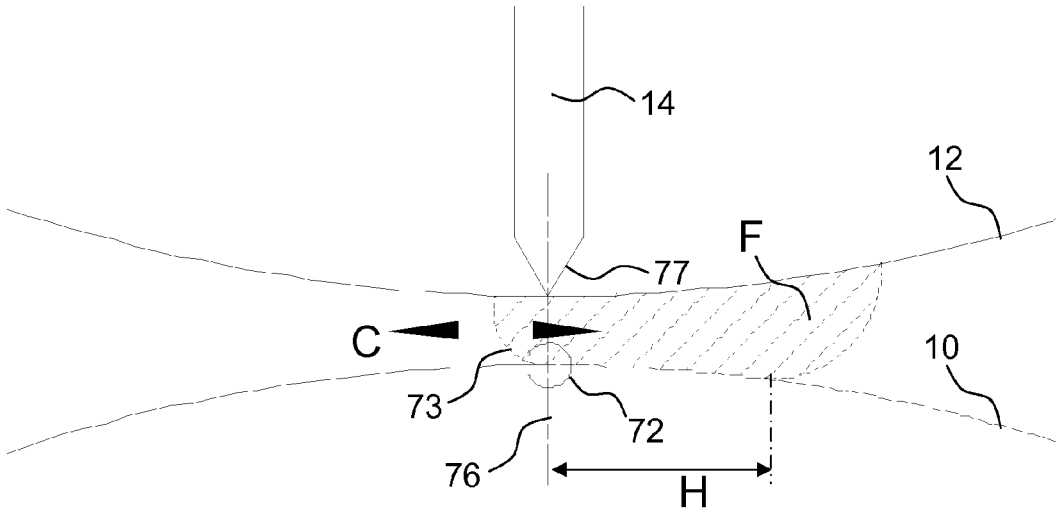
FIG. 4 and FIG. 5 are schematic diagrams of a part of the image forming device at the development area of the toner.
Figure 5:
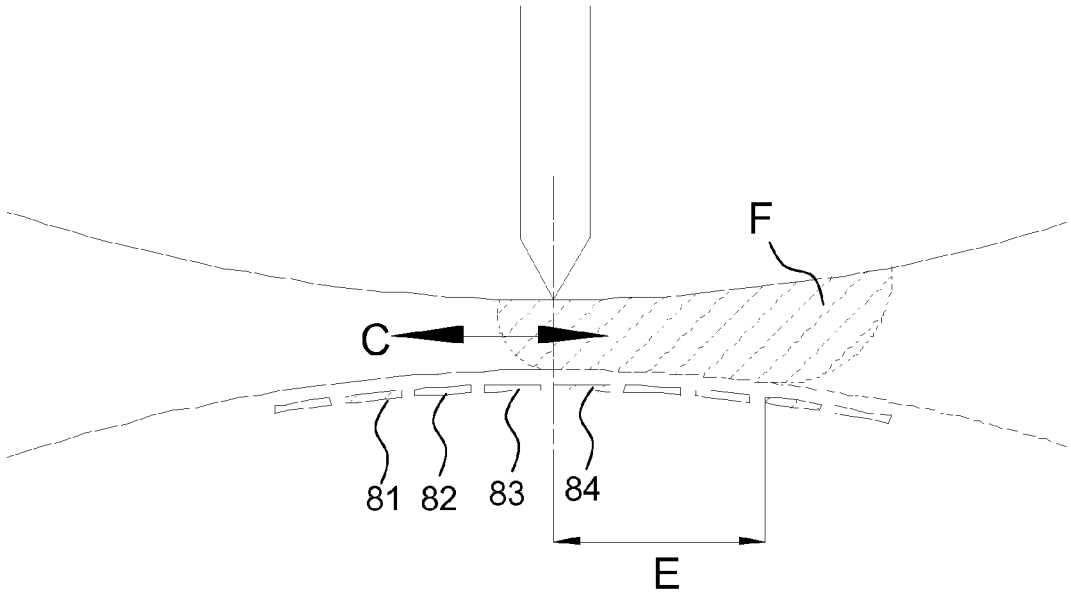

FIG. 1, FIG. 4, FIG. 5 describe amongst others an image forming element in the form of a cylindrical drum. However, the scope of the invention is not limited to a drum shape. Other shapes of the image forming element like a flat shape may be conceived based on the same invention.

As is shown in FIG. 1, an image forming device according to the invention comprises an image forming element shaped as a drum 10 which is rotated in the direction of an arrow A, so that its circumferential surface moves past an image forming station 12. The image forming station 12 comprises a stationary magnetic knife 14 which extends in parallel with the axis of the drum 10 in close proximity to the drum surface. The magnetic knife 14 is surrounded by a non-magnetisable metal sleeve 16 which rotates in the same direction—indicated by an arrow B—as drum 10 and feeds toner substance supplied by a toner supply mechanism (not shown) to the edge of the magnetic knife 14. Since the particles of the toner substance are magnetically attractable, they form a toner brush 18 in the small gap between the sleeve 16 and the drum 10.

The circumferential surface of the drum 10 has a regular pattern of electrodes in the form of circular tracks 20 extending in circumferential direction. The widths and the pitch of the tracks 20 are greatly exaggerated in the drawing. In practice, each of the tracks 20 corresponds to a single column of pixels of the image to be formed on the surface of the drum 10. Thus, when the image resolution of the image forming device is 400 dpi, there will be as many as 400 tracks per inch (per 2.54 cm) in axial direction of the drum 10.

As has been shown in the sectioned part of the drum 10, the tracks 20 are formed by circular electrodes 22, 24 that are embedded in a core layer 23 of the drum 10 so as to be electrically insulated from one another and are covered by an isolating layer 26 in-between the core layer 23 and a semi-conducting top layer 21 of the drum.

The semi-conducting top layer 21 may consist of at least one layer out of a $SiO_x$ layer, where $0<x<2$, a $Si_xC_yH_z$, layer, where $0<x,y<1$, $0<z<0.5$, a $SiN_x$ layer, where $x>0$, a $SiC_xN_y$ layer, where x, $y>0$, and a $SiC_xN_yO_z$ layer, where $0<x<1.5$, $0<y<1$ and $0<z<2$. The proportions of the elements determine the electrical resistance of the top layer.

Figure 2:
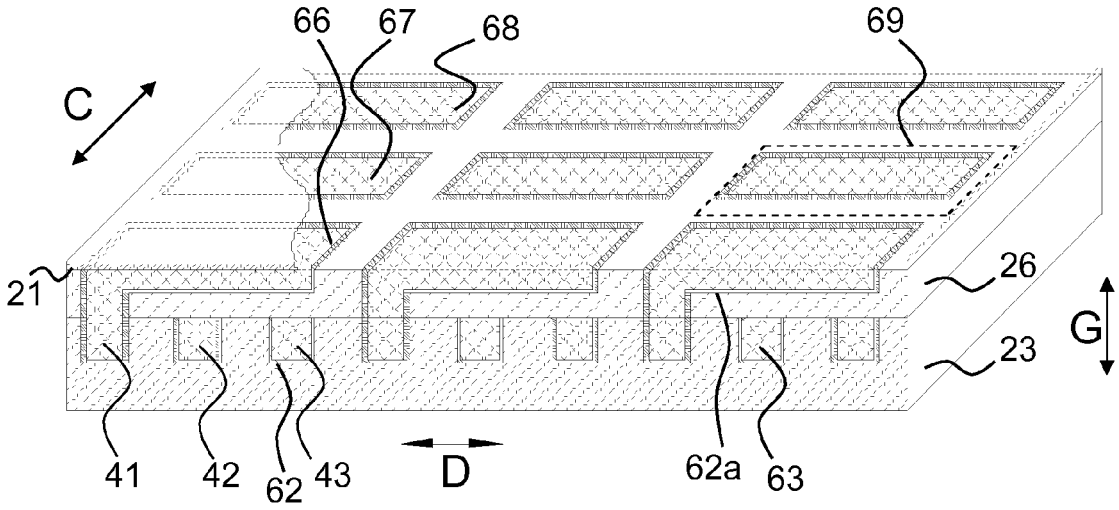
FIG. 2 is a schematic diagram of a part of the image forming element showing the core layer, the intermediate layer and the top layer according to the invention.

The dashed part 25 of the drum 10 comprising the core layer 23, the isolating layer 26 and the semi-conducting top-layer 21 are is described in further detail in FIG. 2.

Each of the electrodes 22, 24 is associated with a driver 28 which controls a voltage to be applied to the electrode and is connectable to the electrode through a switch 30.

In order to form a toner image on the surface of the drum 10, the drivers 28 are activated in accordance with the image information to be printed. When an individual pixel of the image is to be formed, a short voltage pulse of e.g. 40V is applied to the electrode 20 associated with the position of the pixel at the very timing when the point where the pixel is to be formed passes the magnetic brush 18. Since the sleeve 16 is grounded, an electric field develops across the gap between the sleeve 16 and the drum 10 at the position where the pixel is to be formed, and this electric field causes toner particles from the toner brush 18 to be transferred onto the surface of the drum 10, so that an area of toner is formed on the drum. In the example shown, some of the electrodes 22 have been energized in staggered timings, so that a slanting line 32 of toner pixels has been formed on the surface of the drum. When no pixel is to be formed on the track 20 passing the toner brush 18, the corresponding driver 28 is kept de-energized, and the associated electrode 22 is kept approximately at ground potential. In a transfer station 34, the toner image formed on the surface of the drum 40 is transferred, for example, onto a recording sheet (not shown) which is fed into a nip between the drum 10 and a pressure roller 36.

When toner particles 38 adhere to the surface of the semi-conducting top layer 21 covering, e.g., the electrode 24, the electrical properties of the toner particles 38 will change the impedance/capacitance of this electrode 24. As a result, the impedance/capacitance of the electrode 24 will depend on the amount of toner substance that is deposited on the surface area of the drum 10 defined by this electrode 24, i.e. on the corresponding track 20. In order to detect the amounts of toner deposited on each of the tracks 20, each electrode 22, 24 is connectable through the switch 30 and a line 40 to a capacitance measuring circuit 42. In the shown embodiment, the capacitance measuring circuit 42 comprises a switch 44, a voltage source 46, an integrator formed by an operational amplifier 48 and a capacitor 50 in the feedback line of the operational amplifier, and a reset switch 52 for short-circuiting the capacitor 50.

In order to measure the capacitance of the electrode 24, this electrode is at first connected to the voltage source 46 through the line 40 and the switch 44, so that the electrode 24 is charged with a fixed output voltage of the voltage source 46. Then, the switch 44 is switched-over so as to connect the line 40 to the inverting input of the operational amplifier 48 the non-inverting input of which is grounded, so that the electrode 24 is discharged through the operational amplifier 48. The discharge current flowing through the operational amplifier 48 is integrated, and when the electrode 24 is discharged completely, the time integral of the current, i.e. the charge that has flown off from the electrode 24 can be detected at the output 54 of the capacitance measuring circuit 42. The capacitance of the electrode 24 is equal to the charge indicated at the output 54 divided by the voltage of the voltage source 46. In order to eliminate statistical errors, the measurement can be repeated several times by switching the switch 44 back and forth, with the integrator being reset after each measurement by closing the reset switch 52.

In practice, the drivers 28 and the circuitry of the measuring circuit 42, which has only been shown schematically in FIG. 1 may be implemented in integrated circuits on a printed circuit board that is incorporated inside of the drum 10 and is connected to the outside through rotary couplings.

Further, while FIG. 1 shows only a single capacitance measuring circuit 42 which "scans" the electrodes 22, 24 one after the other (by means of the switches 30), it is possible to provide a plurality of capacitance measurement circuits 42 each of which measures the capacitance of only one or a few of the electrodes 22, 24.

FIG. 2 shows a magnification of the dashed part 25 of FIG. 1, which comprises nine tracks of the image forming element in a core layer 23 which is covered by the isolating layer 26 which is on its turn covered by a semi-conducting top layer 21 which is partly shown on the left side of FIG. 2.

The drum comprises the electrodes in the form of the tracks 41, 42, 43, each of which has been grooved into the core layer 23 of the drum in a first direction C which is circular around the drum. The tracks 41, 42, 43 have been grooved at a predetermined depth in a third direction G by means of a well-known technique, for example the technique as described in European patent EP 0303732. The tracks may also be grooved by a laser technique. The tracks 41, 42, 43 are spaced with a predetermined distance in a second direction D perpendicular to the first direction C. The predetermined distance is determined at production of the drum, for example 1200 dpi. The core layer 23 of the drum consists of an isolating epoxy material. The inner spaces of the tracks 41, 42, 43 are filled with at least one conducting material. For example, the inner walls of the tracks 41, 42, 43 have been covered with a metal layer 62 and the remaining inner spaces have been filled with a conducting epoxy material 63. The metal layer may be multi-layered or single layered. A multi-layer may be for example a Cr—Cu—Cr layer or a Ni—Cu—Cr layer. A single layer may be for example an Al layer or a Ti layer. The conducting epoxy material may be conductive Carbon epoxy material.

In the intermediate isolating layer 26 pads 66, 67, 68 are present having a depth in the third direction G. The depth may be for example a half of the thickness of the intermediate isolating layer 26. Each pad 66, 67, 68 is applied across a predetermined number of tracks. The predetermined number of tracks may be equal to 1, 2, 3, 4 or 6. FIG. 2 shows three tracks upon which each pad 66, 67, 68 is stretched in the second direction D. A width of the pad 66, 67, 68 in the first direction C is freely to be selected at the production of the image forming element. The width of a pad 66, 67, 68 in the first direction C may correspond to a desired image forming element resolution in the second direction D. The pads 66, 67, 68 have a rectangular shapes. However, any other suitable shape may be conceived in the scope of the invention.

A grid of pixels 69 has been created which extends in the first direction C as well as in the second direction D of the image forming element. A surface of the resulting image forming element may be lathed. Atop layer 21 of semiconducting material is provided on top of the intermediate isolating layer 26 by well known techniques.

Figure 3:
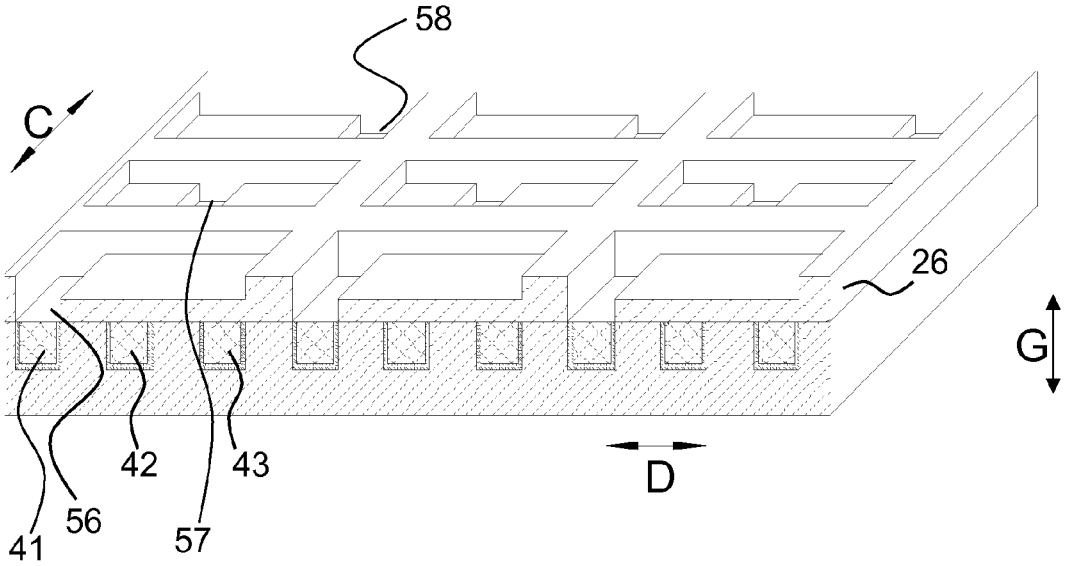
FIG. 3 is a schematic diagram of the same part of the image forming element in which part the top layer has been left out in order to show the intermediate layer in detail.

FIG. 3 shows a cross-sectional diagram of FIG. 2. In order to show interconnections 56, 57, 58 the conducting epoxy material filling the originally open spaces 66, 67, 68 and the top layer 21 have been left out of FIG. 3. The interconnections 56, 57, 58 have been made into the intermediate isolating layer 26 in order to connect the tracks to the respective pads. For example, a first pad 66 (see FIG. 2) is connected in the third direction G to a first track 41 by means of a first interconnection 56, a second pad 67 (see FIG. 2) is connected in the third direction G to a second track 42 by means of a second interconnection 57 and a third pad 68 (see FIG. 2) is connected in the third direction G connected to a third track 43 by means of a third interconnection 58. Interconnections are made around a whole circular surface of each track. Each pad is connected by means of an interconnection with a corresponding track. The interconnections are made in the intermediate layer 26 of the image forming element in the first direction C as well as in the second direction D. Each pad 66, 67, 68 and its corresponding interconnections 56, 57, 58 form an originally connected open space in the intermediate layer 26. The walls of each originally open space of a pad 66, 67, 68 and its corresponding interconnection 56, 57, 58 are provided with at least one conductive material. A metal layer 62*a* (See FIG. 2) may be provided. The metal layer 62, 62*a* may a multi-layer or a single layer. A multi-layer may be for example a Cr—Cu—Cr layer or a Ni—Cu—Cr layer. A single layer may be for example an Al layer or a Ti layer. The metal layer 62, 62*a* may be provided by means of a well known sputtering technique. The originally open spaces 66, 67, 68 in the intermediate layer 26 between the metal layers 62, 62*a* have been filled with a conducting epoxy material by means of a well known coating technique.

Each track 41, 42, 43 of the image forming element may be individually activated by means of the driver 28 according to FIG. 1. By doing so, each third pixel out of a group of three pixels neighbouring in the first direction C will be activated by means of the same track on the image forming element 10. All third pixels on the whole track are activated by the driver corresponding to the track. For example, pixel 69 will be activated by means of track 63 as shown in FIG. 2. However, only the status of pixels at a development area of the toner between the image forming element 10 and the image forming station 12—as shown in FIG. 5—is determining for the development of the toner on the image forming station 12.

FIG. 4 shows a diagram of a part of the image forming device at a development area F of the toner. The image forming element has the shape of a cylindrical drum 10. A development area F of the toner between the drum 10 and the image forming station 12 is determining a degree of the development of the toner on the image forming station 12. More specifically, the development area F is located in the environment of the magnetic knife 14 and extends along the surface of the drum 10 and the image forming station 12. Within a point circle 72 the toner position is determined by activating an appropriate track of the drum 10 at an appropriate moment determined by the image and deactivating the same track at an appropriate moment determined by the image. Charging and de-charging the track will cost time and results in less sharp edges. This situation has a disadvantage with respect to the disposition of an edge of the group of toner particles in the development area F, especially a front side 73 of the development area F. The development area F shifts in time along the surface of the drum 10 and the largeness of the development area F depends on the amount of toner required for the pixels of the image which are to be developed. A quarter circle of the circumference of the development area F shows the front side 73 of the toner amount. A double arrow C exaggeratingly shows a varying position of the development area F, in particular the varying position of the front edge 73. A double sided arrow H defines an area on the surface of the drum 10 at which the development area F extends.

FIG. 5 is a diagram of a part of the image forming device at the development area F of the toner according to the invention. The development area F of the toner between the drum 10 and the image forming station 12 is determining a degree of the development of the toner on the image forming station 12. The development area F is also located between the magnetic knife and the underlying drum surface. However, the toner position per track which extends along the circumference of the drum in the indicated C direction is now determined by means of an activation of a pixel out of the pixels 81, 82, 83, 84 which are situated along the track. According to the invention the first pixel 81 and the fourth pixel 84 may be activated by means of a same track (not shown). The edges of the pixel 81, 84 are determining sharp edges to a group of toner particles which are developed on the drum 10. Since the first pixel 81, the second pixel 82 and the third pixel 83 are connected to a group of three different neighbouring tracks, it is possible to activate or de-activate a next pixel by activating on a second track and/or a third track of the group of three different tracks. Because of the pad construction the on and off switching of a track is not dependent any more of the position of the development area F, in particular the front edge of the development area F. The pad construction results in sharp edges of toner to be developed in the development area. For each section E of three subsequent pixels on the drum in the first direction C it is determinable which pixels of the three subsequent pixels should be activated or not.

In the embodiment described here-above, a group of three tracks are combined to a single array of pixels. However, the invention is not limited to a group of three tracks. Experiments have shown that a section comprising a group of at least one track is large enough in relation to the size in the second direction D of the development area between the magnetic knife and the image forming element. A drum having a resolution of 1200 dpi in the axial direction D may be treated according to the invention to create a direct imaging drum having an axial resolution of 1200 dpi, 600 dpi, 400 dpi, 300 dpi or 200 dpi respectively by clustering 1, 2, 3, 4 or 6 tracks respectively.

In case of clustering 1 track only, the size in the first direction C of the development area is at its smallest, since by activating the underlying track, all pads are activated and will attract toner if arriving at the development area.

The tangential resolution of the drum is selectable and depends amongst other factors on a desired size in the first direction C of the section E. If a tangential movement of the toner in the development area is measured to be at most 100 micrometer, a size in the first direction C of the section E of approximately 100/2=50 micrometer per pixel is conceivable. This size is suitable for producing a drum with an axial resolution of 200 dpi, 300 dpi, 400 dpi, 600 dpi. Image forming devices may be produced comprising a direct imaging drum having a resolution of 600 dpi by 600 dpi, 600 dpi by 400 dpi, 400 dpi by 600 dpi and 400 dpi by 400 dpi. These embodiments of image forming devices are conceivable but the invention also includes embodiments having resolutions in the same order of magnitude.

The invention is advantageous because of an improvement of a reproduction quality of the images and a graininess of the images. Image edges are determined by the status of each pixel in the development area. The section E is so large that a pixel can be addressed before it actually enters the development area. Another advantage is that the tolerances with respect to the properties of the magnetic knife as well as a size distribution of the toner particles are enlarged.

The invention claimed is:

1. An image forming device comprising at least one image forming element moving past an image forming station in which toner is deposited on a surface of the image forming element, which surface is facing the image forming station, said image forming element comprising a core layer forming a core of the image forming element and comprising a plurality of tracks comprising electrodes individually connected to corresponding drivers;

a semi-conducting top layer forming the surface of the image forming element; and an isolating layer in between the core layer and the semi-conducting top layer, wherein the isolating layer comprises a plurality of pads each of which extends over at least one track of the plurality of tracks in a non-overlapping manner, extends from one underlying track of the plurality of tracks to the semi-conducting top layer as to form an interconnection with the one underlying track of the plurality of tracks, and is filled with a conducting material in order to let each pad individually be activated by means of the driver of the underlying track of the plurality of tracks in order to adhere toner on a location of the surface of the image forming element, which location corresponds to the underlying activated pad.

2. The image forming device according to claim 1, wherein the conducting material consists of a metal layer and a conducting epoxy filling material.

3. The image forming device according to claim 2, wherein the metal layer is a layer out of a multilayer of Cr and Cu, a multilayer of Ni, Cu and Cr, a layer of Al and a layer of Ti.

4. The image forming device according to claim 2, wherein the conducting epoxy filling material comprises Cu.

5. The image forming device according to claim 2, wherein the semi-conducting top layer consists of at least one layer out of a $SiO_x$ layer, where $0<x<2$, a $Si_xC_yH_z$ layer, where $0<x, y<1$, $0<z<0.5$, a $SiN_x$ layer, where $x>0$, a $SiC_xN_y$ layer, where $x, y>0$, and a $SiC_xN_yO_z$ layer, where $0<x<1.5$, $0<y<1$ and $0<z<2$.

6. The image forming device according to claim 3, wherein a number of tracks over which a pad is extended is equal to one out of one, two, three, four and six.

7. The image forming device according to claim 1, wherein the core layer is a drum having a plurality of electrodes extending circumferentially on or below the outer surface of the drum and corresponding each to a row of pixels of a toner image to be formed.

8. The image forming device according to claim 1, wherein a width of a pad in a first direction which is circular around the image forming element corresponds to a resolution of the image forming element in a second direction perpendicular to the first direction.

* * * * *